United States Patent [19]

Graham et al.

[11] 4,013,985

[45] Mar. 22, 1977

[54] THREE-PHASE CURRENT TRANSFORMER

[75] Inventors: Robert O. Graham, Milwaukee; John A. Rauenbuehler, New Berlin, both of Wis.

[73] Assignee: Cutler-Hammer, Inc., Milwaukee, Wis.

[22] Filed: Apr. 15, 1976

[21] Appl. No.: 677,407

[52] U.S. Cl. ..... 336/5; 336/90; 336/175

[51] Int. Cl.[2] ..... H01F 27/04

[58] Field of Search ..... 336/5, 10, 12, 90, 92, 336/173, 174, 175, 192

[56] References Cited

UNITED STATES PATENTS

| | | | |
|---|---|---|---|
| 2,618,689 | 11/1952 | Cook, Jr. | 336/175 X |
| 2,644,135 | 6/1953 | Schnoll | 336/175 X |

*Primary Examiner*—Thomas J. Kozma
*Attorney, Agent, or Firm*—Hugh R. Rather; William A. Autio; Michael E. Taken

[57] ABSTRACT

A unitary three-phase current transformer having its three iron cores and three secondary coils enclosed and retained in their positions by a pair of like molded housing halves. The housing halves also have pairs of juxtaposed slots in their upper, adjacent edges for clamping pairs of secondary coil terminal inserts therebetween to mount the same so as to allow connection of the secondary coils to external conductors. The housing halves are connected together by symmetrically arranged sets of screws with the screws of each set extending through holes in the respective half and threaded into the respectively opposite half. The asembled housing halves provide three apertures through which are inserted respective bus bars serving as one-turn primary windings. A terminal strap is attached to one end of each bus bar, the bus bar is inserted through the aperture, and the other terminal strap is attached to the other end thereof. The housing halves also have slots defined by pairs of lugs through which screws extend rigidly to fix the two outer bus bars thereto, the terminal straps serving as both mounting means and electrical connecting means for the transformer.

10 Claims, 7 Drawing Figures

THREE-PHASE CURRENT TRANSFORMER

BACKGROUND OF THE INVENTION

Three-phase current transformers have been known heretofore. However, these prior three-phase transformers generally have been constructed by mounting three, individual coil-core subassemblies separately on a support or mounting panel, thus requiring more panel space and having more mounting problems than would be the case with a unitary transformer. Prior three-phase transformers have also been constructed by encapsulating all three-coil-core subassemblies in a mass of molding or casting material of the electrical insulating and heat conducting type such as plastic. However, such cast construction cannot be disassembled for repair or replacement of parts without destroying it.

While these prior plural-phase current transformers have been useful for their intended purpose, it has been found desirable to provide an improved three-phase current transformer overcoming the aforesaid disadvantages.

SUMMARY OF THE INVENTION

An object of the invention is to provide an improved current transformer.

A more specific object of the invention is to provide an improved unitary plural-phase current transformer.

Another specific object of the invention is to provide an improved three-phase current transformer than can be easily assembled.

Another specific object of the invention is to provide an improved plural-phase current transformer structure that is simple in construction and reduces the total number of different parts.

Another specific object of the invention is to provide the core-coil subassemblies of a plural-phase current transformer with a pair of like, insulating housing halves which also clamp therebetween the pairs of coil terminals.

Another object of the invention is to provide a three-phase current transformer of reduced size requiring less panel space for mounting.

Another object of the invention is to provide a unitary, compact three-phase current transformer that can be readily disassembled for repair or replacement of parts.

Other objects and advantages of the invention will hereinafter appear.

DESCRIPTION OF THE PREFERRED EMBODIMENT

Figure 1:
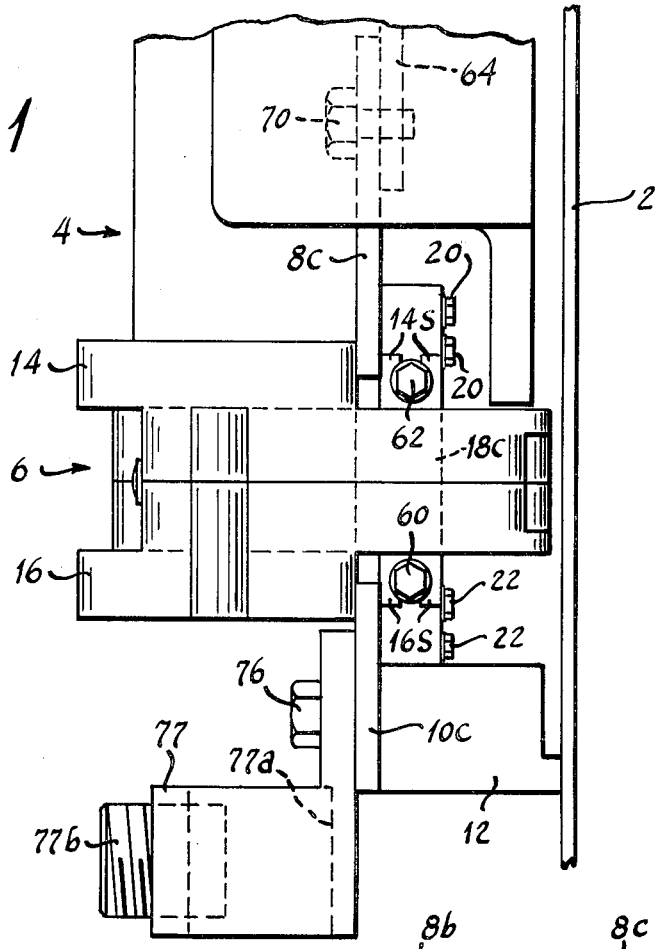
FIG. 1 is a reduced, partial, right-side elevational view of a three-phase motor starter showing an end view of the three-phase current transformer.
Figure 2:
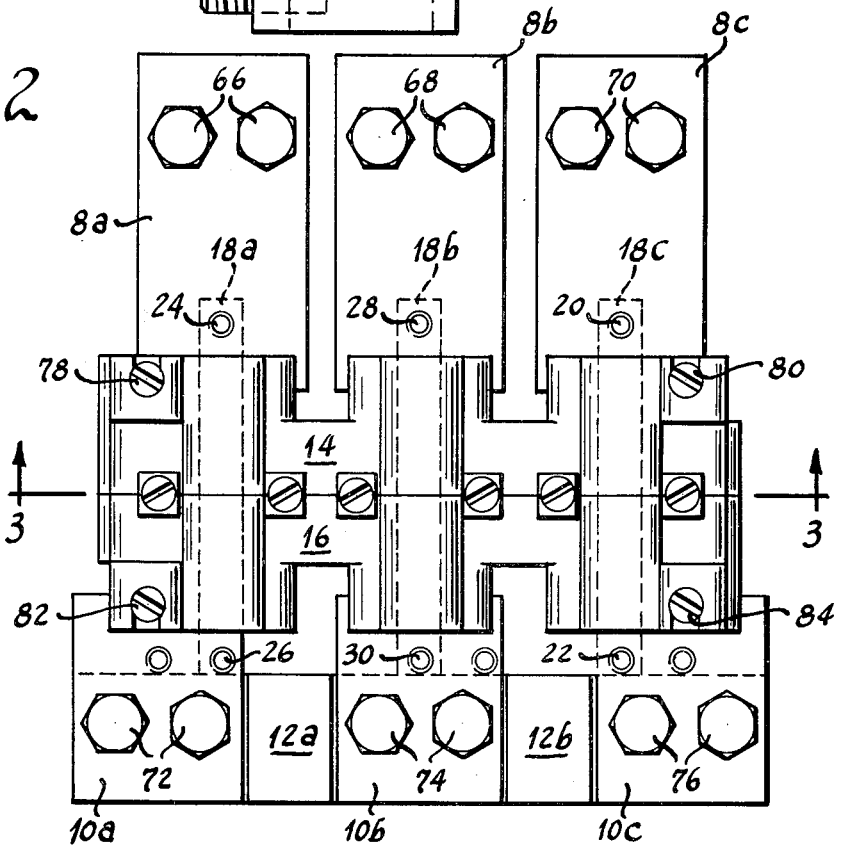
FIG. 2 is a top plan view of the three-phase current transformer and mounting block of FIG. 1 minus the connector lugs.

Referring to FIGS. 1 and 2, there is shown the lower portion of a three-phase A.C. motor starter supported on a mounting plate 2 whereby it is normally attached within an enclosure. This starter comprises an electromagnetic contactor 4, shown partially in FIG. 1, an overload relay (not shown), and a three-phase current transformer 6 supported by its three line side terminal straps 8*a–c* on the terminals of the contactor and by its three load-side terminal straps 10*a–c* on a mounting block 12 of insulating material as hereinafter described.

This three-phase current transformer is provided with a pair of like, complementary molded insulating material housing halves 14 and 16 held tightly together by a plurality of screws in two symmetrical sets threaded in from opposite sides. These housing halves retain therewithin the secondary coils and cores as hereinafter described. Three single-turn primary windings are provided by bus bars 18*a–c* extending through apertures in these housing halves and through the cores. Terminal straps 8*c* and 10*c* are connected to opposite ends of bus bar 18*c* by two pairs of screws 20 and 22, respectively, as shown in FIGS. 1 and 2. In a similar manner, terminal straps 8*a* and 10*a* are connected to opposite ends of bus bar 18*a* by two pairs of screws 24 and 26, respectively. And terminal straps 8*b* and 10*b* are connected to opposite ends of bus bar 18*b* by two pairs of screws 28 and 30, respectively. For this purpose, each terminal strap 8*a–c* is provided with a pair of tapped holes at the center of one end portion into which the pair of screws, first passing through corresponding holes in the upper end of the bus bar, are threaded, rigidly to secure the terminal strap to the bus bar. Each of terminal straps 10*a–c* is provided with two pairs of tapped holes, one pair at the center of one end and another pair offset to one side of the center of such end. Terminal strap 10*b* is connected to its bus bar symmetrically at its center holes while terminal straps 10*a* and 10*c* are connected at their offset holes. Thus, a terminal strap like 10*a* can be used for 10*c* by merely turning it over and then securing it to the bus bar. These offset holes by which terminal straps 10*a* and 10*c* are secured to their respective bus bars afford greater electrical clearance between the three terminal straps 10*a–c*.

Figure 3:
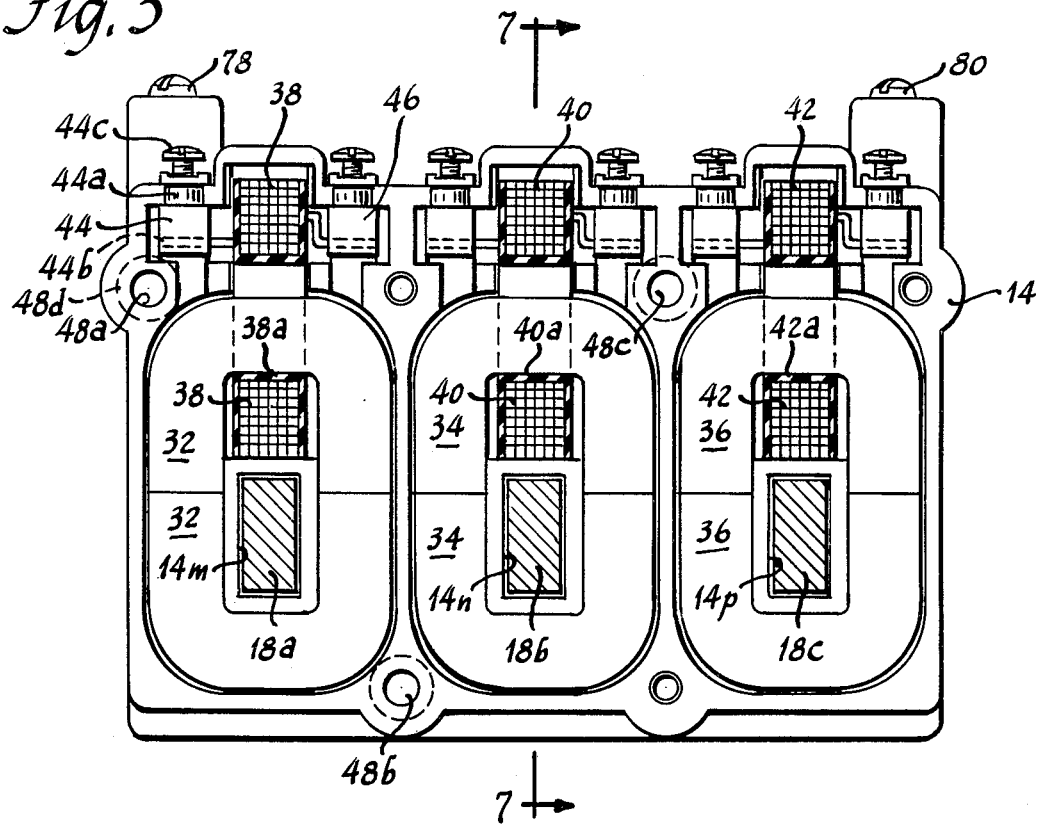
FIG. 3 is a full size, longitudinal cross-sectional view taken along line 3—3 of FIG. 2 showing the cores, coils and coil terminals.
Figure 6:
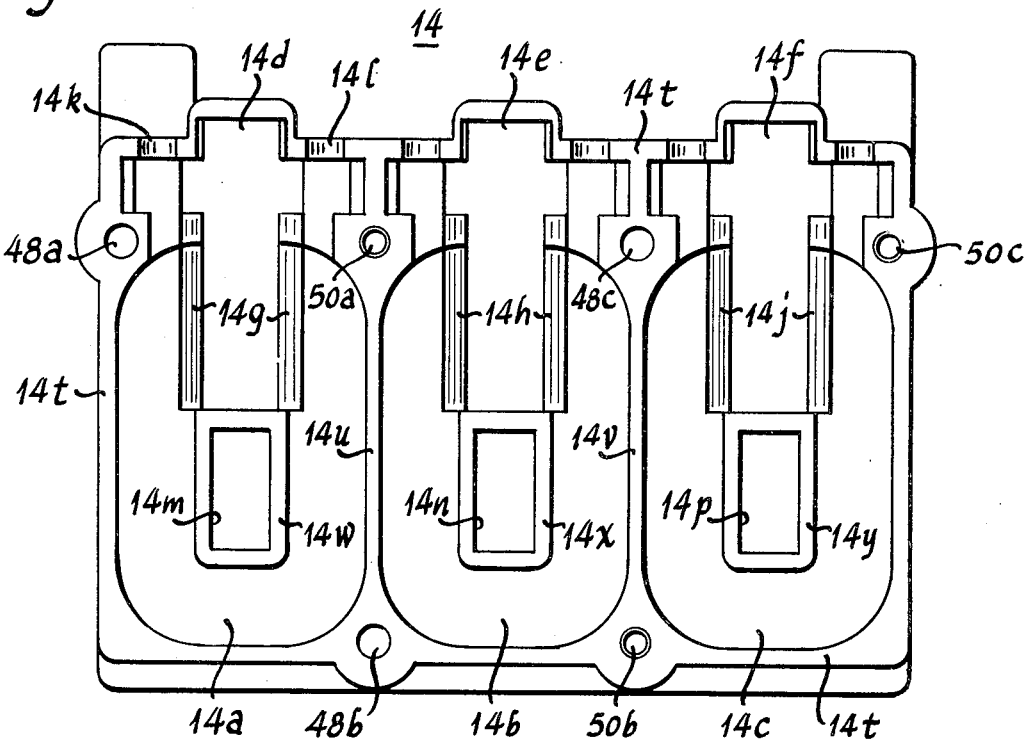
FIG. 6 is an internal view of one of the two housing halves of the three-phase current transformer of FIG. 5 showing the molded cavities therein for the secondary coil, core and coil terminals.
Figure 4:
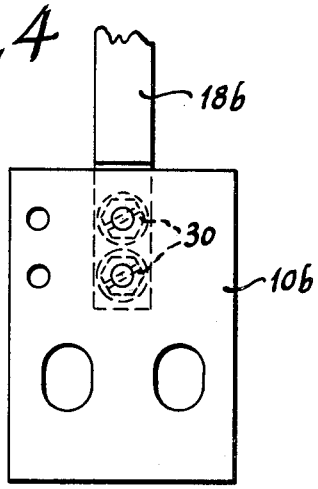
FIG. 4 is a top plan view of the center one of the three "load" terminal straps and a portion of the bus bar of the current transformer of FIG. 3, also shown reduced in FIG. 2.

The interior configuration of one of the two, like housing halves is shown in FIG. 6, this being housing half 14. As shown therein, this housing half is provided with three cavities 14*a–c* for receiving the three split cores 32, 34 and 36 of the three-phase current transformer. Three deeper cavities 14*d–f* extend from the upper portions of cavities 14*a–c* for receiving the three secondary coils 38, 40 and 42, respectively, that are placed around the upper portions of the associated split cores as shown in FIG. 3. The corners 14*g*, 14*h* and 14*j* between the core cavities and the deeper coil cavities are beveled to facilitate insertion of the coils thereinto.

This housing half is provided with a first pair of semi-circular notches 14*k* and 14*L* in the joining edge of its upper wall, one on each side of coil cavity 14*d*, and having access thereinto through shallow portions of the cavity so that when the two halves are abutted, round holes are provided for clamping secondary coil terminal inserts 44 and 46 as shown in FIG. 3. Second and third pairs of similar, semi-circular slots are provided adjacent coil cavities 14*e* and 14*f* as shown in FIG. 6 for similar purposes. As shown in FIG. 3, each secondary coil terminal insert such as 44 is an elongated, generally rectangular member, generally square in horizontal cross-section as seen in FIG. 3, and having an annular groove 44*a* around its upper end portion. The bottom of this groove is round and fits snugly between the rims of the abutting semi-circular slots in the housing halves that form a round hole to retain the terminal insert in place. The lower portion of this insert is provided with a wire connector such as a small lateral hole 44*b* therethrough into which one end of secondary coil 38 wire is inserted and soldered to make an electrical connection. A tapped hole extends partway down from the upper, external end of insert 44 and receives a screw 44*c* for connecting the secondary coil via a conductor to a load device. Insert 46 is similar to insert 44 just described and is connected to the other end of secondary coil 38. Similarly, a pair of terminal inserts is provided for each of secondary coils 40 and 42 and mounted and connected in a similar manner as inserts 44 and 46 just described.

Figure 5:
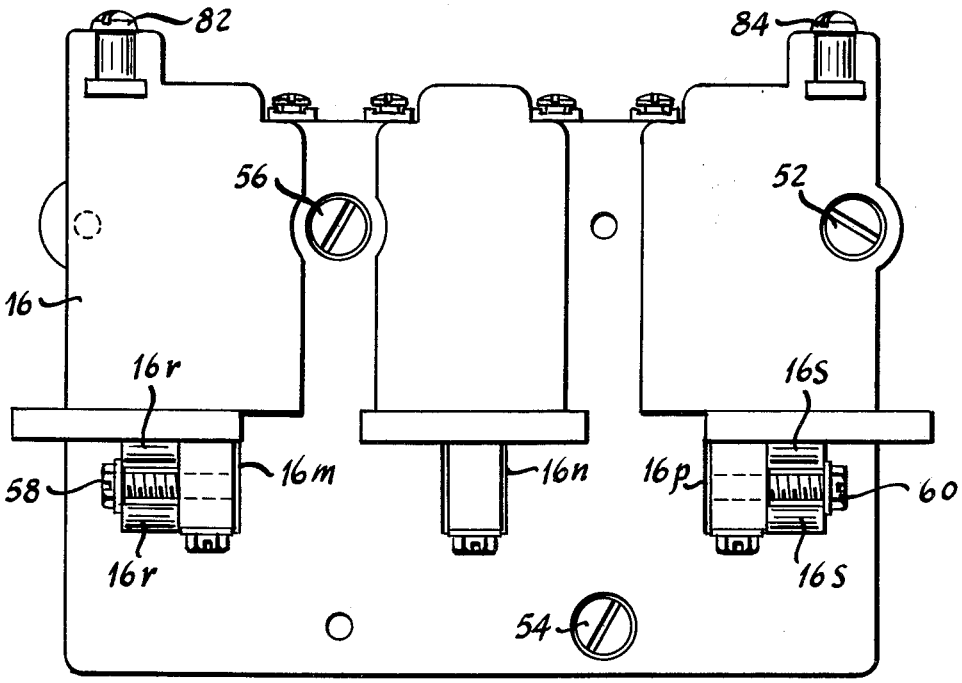
FIG. 5 is a front elevational view of the three-phase current transformer of FIG. 3 showing the exterior configuration and retaining screws.
Figure 7:
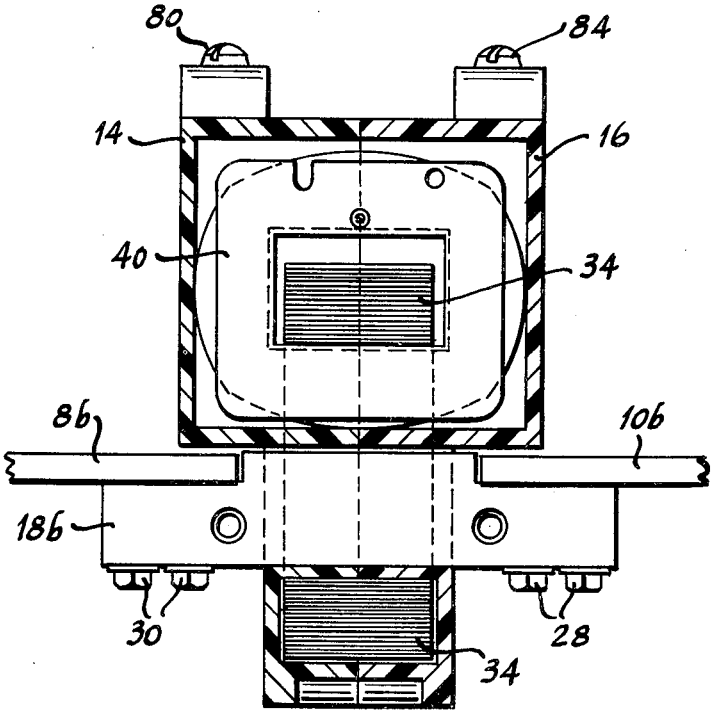
FIG. 7 is a transverse cross-sectional view taken along line 7—7 of FIG. 3 to show the arrangement of the secondary coil, core and bus bar.

This housing half shown in FIG. 6 is also provided with three apertures 14*m*, 14*n* and 14*p* aligned with apertures 16*m*, 16*n* and 16*p*, respectively, of the other housing half 16 through which the bus bars extend as shown in FIGS. 3, 5 and 7.

This housing half shown in FIG. 6 is provided with a plurality of walls whose edges abut the corresponding edges of complementary walls on the other housing half. These walls include a peripheral wall 14*t* that has an abutting edge that is unbroken except for the three pairs of semi-circular notches such as 14*k* and 14*L* in its upper portion. These walls also include dividing walls 14*u* and 14*v* that separate the three coil-core retaining cavities. And these walls further include aperture-lining walls, 14*w*, 14*x* and 14*y* that line bus bar apertures 14*m*, 14*n* and 14*p* and separate the bus bars from the split loop cores.

This housing half is also provided with two symmetrically disposed sets of holes with three holes 48*a–c* in the first set and three holes 50*a–c* in the second set. These sets of holes are so arranged that the holes of the first set of housing half 14 will line up with the holes of the second set of housing half 16, and the holes of the first set of housing half 16 will line up with the holes of the second set of housing half 14 when the housing halves are assembled in abutting relation. As shown in FIG. 6, holes 48*a–c* of the first set in housing half 14 are larger so that screws can be passed therethrough into thread-cutting engagement with the smaller holes of the second set in housing half 16. And the holes of the first set in housing half 16 are likewise larger so that similar screws 52, 54 and 56 shown in FIG. 5 can be inserted therethrough into thread-cutting engagement with the smaller holes of the second set in housing half 14. The larger holes in each housing half are suitably counter-bored as indicated by the broken lines 48*d–f* in FIG. 3 to allow use of common length screws for attaching the housing parts together.

As shown in FIG. 3, each coil 38, 40 and 42 is wound on a bobbin 38*a*, 40*a* and 42*a* of plastic material or the like. The upper half of each split core 32, 34 and 36 is then pushed through the hole in the respective bobbin. These subassemblies along with the lower half of the split cores which are cemented to the upper halves are then pressed into their cavities. The other housing half is then placed on top and the two sets of attaching screws are inserted from respectively opposite sides and turned tight.

Terminal straps 8*a–c* are then attached by pairs 20, 24 and 28 of screws to first ends of the three bus bars, these bus bars are inserted through the apertures in the housing, and terminal straps 10*a–c* are attached by pairs 22, 26 and 30 of screws to the other ends of the bus bars.

The two housing halves are also provided with means for rigidly securing the outer two bus bars thereto. This means comprises a pair of spaced projections or lugs 16*r* alongside aperture 16*m* as shown in FIG. 5 and a pair of similar spaced projections or lugs 16*s* alongside aperture 16*p* on the outer surface of the housing half. Screws 58 and 60 are inserted between the projections of the respective pairs thereof into threaded engagement in tapped holes in the corresponding bus bars. Similar pairs of projections or lugs are provided in like locations on housing half 14 and similar screws are used to attach bus bars 18*a* and 18*c* rigidly to that housing half, one pair 14*s* of these lugs and associated screw 62 being shown in FIG. 1. The locations of these tapped holes in the bus bars are shown in FIG. 7 with respect to center bus bar 18*b*, all three bus bars being alike for ease of production although these tapped holes are used only on the first and third bus bars 18*a* and 18*c*. The center bus bar relies for rigidity of mounting on its connections of the terminal straps as hereinafter described.

The three-phase current transformer is supported at its line side, as seen in FIGS. 1 and 2, on the terminals such as 64 of contactor 4. For this purpose, terminal straps 8*a–c* are connected by three pairs of screws 66, 68 and 70, shown in FIG. 2, to the respective three terminals of the contactor for both physical support and electrical connections.

The current transformer is supported at its load side, as seen in FIGS. 1 and 2, on mounting block 12. For this purpose, mounting block 12 is fixed to mounting plate 2. This is preferably done by inserting a pair of screws through spaced apart holes in the mounting plate into threaded engagement with a pair of tapped inserts secured within the lower side of the mounting block. To support the transformer, terminal straps 10*l–c* rest on the upper surface of the mounting block and are secured thereto by respective pairs of screws 72, 74 and 76 threaded into tapped inserts secured within the upper side of the mounting block. Portions 12*a* and 12*b* of this mounting block extend up above the terminal straps to increase the electrical clearance therebetween.

To facilitate connection of large electrical conductors to terminal straps 10*a–c*, suitable connector lugs 77 shown in FIG. 1 are secured under the heads of screw pairs 72, 74 and 76 in actual practice and the conductors are then readily secured to such lugs by inserting the stripped ends thereof into the holes 77*a* in these lugs and tightening the transverse set screws 77*b* in known manner.

The aforesaid three-phase current transformer is provided with means for mounting a load device such as an overload relay thereon and to which the secondary coils of the current transformer are connected. This means comprises inserts 78, 80, 82 and 84 shown in FIGS. 2 and 5 pressed laterally into slots in the riser portions at the four upper corners of the assembled housing. Each of these inserts has an enlarged square base and an upstanding portion as shown in FIG. 5 and is frictionally held against lateral movement in its inverted T-shaped slot in the housing. Each of these inserts also has a tapped hole extending down from its top for receiving a mounting screw as shown in FIG. 2. These four screws are arranged to secure a mounting plate on top of the transformer housing. Such mounting plate mounts an overload relay (not shown) which is adapted to be connected to the three secondary coils of the three-phase current transformer. Thus, the current transformer is preferably used to supply reduced current from the bus bars to the overload relay which will detect and initiate protective action for the motor in the event an excessive current condition occurs.

While the three-phase current transformer has been shown and described as used in connection with a motor starter, other equivalent applications thereof are possible.

While the apparatus hereinbefore described is effectively adapted to fulfill the objects stated, it is to be understood that the invention is not intended to be confined to the particular preferred embodiment of three-phase current transformer disclosed, inasmuch as it is susceptible of various modifications without departing from the scope of the appended claims.

We claim:

1. A unitary plural-phase current transformer comprising:

an insulating housing comprising abutting, complementary housing parts having a plurality of walls enclosing a plurality of cavities therewithin and pairs of adjoining notches in abutting edges of corresponding walls thereof providing a pair of holes from each said cavity to the outside;

a plurality of secondary coil and loop magnetic core combinations, one in each of said cavities;

a plurality of pairs of terminal inserts retained in said pairs of holes with the inserts of each pair thereof connected to the respective ends of a different secondary coil and each said insert having an electrical connector portion;

aligned apertures extending through both of said housing parts and through the respective loop magnetic cores therein;

bus bars extending through said apertures and said loop magnetic cores, respectively, and serving as one-turn primary windings for the transformer;

and means rigidly securing said housing parts together to enclose said coil-core combinations and portions of said inserts with the electrical connector portions of said inserts being accessible from the outside for connection to an external device.

2. The unitary plural-phase current transformer defined in claim 1, wherein:

said abutting, complementary housing parts comprise a pair of molded housing halves, each having a plurality of walls abutting corresponding walls of the other half, and said plurality of walls including a peripheral wall having a continuous abutting edge except for said pairs of notches therein, dividing walls between said cavities, and aperture lining walls enclosing said cavities from said apertures through which said bus bars extend.

3. The unitary plural-phase current transformer defined in claim 1, wherein:

said abutting, complementary housing parts comprise a pair of like molded housing halves having sets of symmetrically arranged holes therein;

and said means rigidly securing said housing parts together comprise a plurality of retaining members extending through a first set of said holes in one housing half to retain the other housing half thereagainst and a plurality of like retaining members extending through another set of said holes in the other housing half to retain said one housing half thereagainst.

4. The unitary plural-phase current transformer defined in claim 1, wherein:

said notches in said abutting edges of corresponding walls are semi-circular notches whereby adjoining notches provide round holes, and each said terminal insert comprises an annular groove and the rim of each said hole grips the corresponding terminal insert by its annular groove to secure the latter in place when said housing parts are secured together.

5. The unitary plural-phase current transformer defined in claim 1, wherein:

each of said loop magnetic cores comprises a split core having a pair of U-shaped laminated sections, with one of said sections inserted through the associated secondary coil, and the two sections being held in their cavity in abutting relation to form a closed magnetic loop.

6. The unitary plural-phase current transformer defined in claim 1, wherein:

each said bus bar comprises a terminal strap secured to each end thereof;

and said terminal straps comprise means for electrically connecting and supporting said transformer.

7. A unitary three-phase current transformer comprising:

an insulating housing comprising like, abutting housing halves, each having a plurality of walls edge-abutting complementary walls of the other half to enclose three cavities therewithin and pairs of adjoining notches in abutting edges of corresponding upper peripheral walls thereof forming a pair of holes leading into each of said cavities;

three secondary coil and closed magnetic core combinations, one in each of said three cavities;

three pairs of terminals gripped by the rims of said pairs of holes and each said terminal having wire connecting means within the respective cavity connected to one side of the respective secondary coil and an external terminal;

three aligned apertures through said housing halves passing through said closed magnetic cores, respectively;

three bus bar and terminal strap assemblies extending through said apertures and serving as one turn primary windings for the three-phase transformer;

and symmetrically arranged sets of screws extending through the respective housing halves and threaded into the respectively opposite housing halves to rigidly secure them together.

8. The unitary three-phase current transformer defined in claim 7, wherein:

said three bus bar and terminal strap assemblies comprise terminal straps wider than the bus bars secured to each end of each bus bar;

the terminal straps at first ends of said bus bars being load side terminal straps and the terminal straps at the other ends of said bus bars being line side terminal straps;

each of said load side terminal straps alike and having alternative center and offset securing means;

the center terminal strap of the three load side terminal straps being secured to its bus bar by its center securing means;

and both side terminal straps of the three load side terminal straps being secured to their bus bars by their offset securing means with one of said side terminal straps being reversed with respect to the other whereby to afford maximum electrical spacing between these load side terminal straps.

9. The unitary three-phase current transformer defined in claim 7, wherein:

said housing comprising raised pedestals at the four upper corners thereof;

and tapped inserts in said pedestals for securing a load device on top of said transformer.

10. The unitary three-phase current transformer defined in claim 7, wherein:

each of said housing halves comprises screw-retaining lugs adjacent to and outwardly of its two outer apertures therein;

tapped holes in the two outer bus bars in alignment with the adjacent lugs;

and screws retained by said lugs and threaded into said tapped holes to secure the corresponding bus bars rigidly to said housing.

* * * * *